US008469013B1

(12) United States Patent
Obteshka et al.

(10) Patent No.: US 8,469,013 B1
(45) Date of Patent: Jun. 25, 2013

(54) CABLE TAKE-UP OR LET-OUT MECHANISM FOR A COMPOUND ARCHERY BOW

(75) Inventors: Nicholas C. Obteshka, Springfield, OR (US); Craig T. Yehle, Junction City, OR (US)

(73) Assignee: Extreme Technologies, Inc., Eugene, OR (US)

( * ) Notice: Subject to any disclaimer, the term of this patent is extended or adjusted under 35 U.S.C. 154(b) by 364 days.

(21) Appl. No.: 12/985,659

(22) Filed: Jan. 6, 2011

(51) Int. Cl.
*F41B 5/10* (2006.01)

(52) U.S. Cl.
CPC . *F41B 5/10* (2013.01); *F41B 5/105* (2013.01); *Y10S 124/90* (2013.01)
USPC ..... 124/25.6; 124/23.1; 124/86; 124/90; 124/900

(58) Field of Classification Search
CPC ..... F41B 5/10; F41B 5/105
USPC ..... 124/23.1, 25.6, 86, 90, 900
See application file for complete search history.

(56) References Cited

U.S. PATENT DOCUMENTS 3,990,425 A * 11/1976 Ketchum ..... 124/25.6
4,300,521 A 11/1981 Schmitt
4,440,142 A * 4/1984 Simonds ..... 124/25.6
4,546,754 A * 10/1985 Smith ..... 124/86
4,686,955 A * 8/1987 Larson ..... 124/25.6
4,733,648 A * 3/1988 Martin ..... 124/86
4,781,167 A * 11/1988 Martin ..... 124/25.6
4,909,231 A * 3/1990 Larson ..... 124/23.1
5,368,006 A * 11/1994 McPherson ..... 124/25.6
5,381,777 A * 1/1995 Mitchell et al. ..... 124/25.6
5,390,655 A * 2/1995 Mitchell et al. ..... 124/25.6
5,505,185 A * 4/1996 Miller ..... 124/25.6
5,623,915 A * 4/1997 Kudlacek ..... 124/25.6
5,890,480 A * 4/1999 McPherson ..... 124/25.6
5,975,067 A * 11/1999 Strother ..... 124/25.6
6,082,347 A * 7/2000 Darlington ..... 124/25.6
6,237,582 B1 * 5/2001 McPherson ..... 124/25.6
6,443,139 B1 * 9/2002 McPherson ..... 124/25.6
6,474,324 B1 * 11/2002 Despart et al. ..... 124/25.6
6,659,096 B1 * 12/2003 Nealy et al. ..... 124/25.6
6,688,295 B1 * 2/2004 Miller ..... 124/25.6
6,691,692 B1 * 2/2004 Adkins ..... 124/25.6
6,792,930 B1 * 9/2004 Kronengold et al. ..... 124/25.6

(Continued)

OTHER PUBLICATIONS

U.S. Appl. No. 12/511,085, filed Jul. 29, 2009, Yehle.

(Continued)

*Primary Examiner* — Gene Kim
*Assistant Examiner* — Alexander Niconovich
(74) *Attorney, Agent, or Firm* — David S. Alavi

(57) ABSTRACT

A compound archery bow comprises a riser, limbs, pulley members connected to the limbs, a draw cable, and a power cable. A first pulley member includes a draw cable journal, a power cable take-up mechanism, and coaxial axle segments extending from opposite sides of the pulley member. The effective lever arm of the power cable take-up mechanism decreases, during a latter portion of drawing the bow, from a distance that is greater than a radius of the axle segments to a minimum distance that is less than that radius. The first pulley member is further arranged so that, with the bow fully drawn, at least a portion of the power cable passes through at least a portion of a space between the first and second axle segments.

24 Claims, 8 Drawing Sheets

U.S. PATENT DOCUMENTS

| | | | | |
|---|---|---|---|---|
| 6,871,643 | B2 * | 3/2005 | Cooper et al. | 124/25.6 |
| 6,976,484 | B1 * | 12/2005 | Gallops, Jr. | 124/25.6 |
| 6,990,970 | B1 * | 1/2006 | Darlington | 124/25.6 |
| 6,994,079 | B1 * | 2/2006 | Darlington | 124/25.6 |
| 7,082,937 | B1 * | 8/2006 | Land | 124/25.6 |
| 7,143,757 | B1 * | 12/2006 | Cooper | 124/25.6 |
| 7,305,979 | B1 * | 12/2007 | Yehle | 124/25.6 |
| 7,311,098 | B2 * | 12/2007 | Gallops, Jr. | 124/25.6 |
| 7,441,555 | B1 * | 10/2008 | Larson | 124/25.6 |
| 7,770,568 | B1 * | 8/2010 | Yehle | 124/25.6 |
| 8,006,679 | B2 * | 8/2011 | Strother | 124/25.6 |
| 8,020,544 | B2 * | 9/2011 | McPherson et al. | 124/25.6 |
| 8,205,607 | B1 * | 6/2012 | Darlington | 124/25.6 |
| 8,220,446 | B2 * | 7/2012 | Batdorf | 124/25.6 |
| 8,276,574 | B1 * | 10/2012 | Wilson | 124/25.6 |
| 8,281,774 | B2 * | 10/2012 | Grace | 124/25.6 |
| 8,281,775 | B1 * | 10/2012 | Larson | 124/25.6 |
| 8,360,041 | B2 * | 1/2013 | Strother | 124/25.6 |
| 2009/0288650 | A1 * | 11/2009 | Batdorf | 124/25.6 |

OTHER PUBLICATIONS

U.S. Appl. No. 12/690,783, filed Jan. 20, 2010, Yehle.

Krenz, Bill: "Mathews McPherson Series Monster"; Inside Archery (Jun. 2009; p. 30); http://mathewsinc.com/data/mathewsinc/file/245_45289_Mathews%20Monster_2.pdf.

Silks, Jon E.; "Mathews McPherson Series Monster"; Bowhunting (Aug. 2009; p. 18); http://mathewsinc.com/data/mathewsinc/file/245_45293_BOWP-090800-HGM.pdf.

Bell, Joe; "Mathews McPherson Series Monster"; Bow & Arrow Hunting (believed published in 2009); http://mathewsinc.com/data/mathewsinc/file/245_44981_BOW_4.pdf.

Hartle, Luke L.; ". . . And Then There Were Two"; North American Hunter (believed published in 2009); http://mathewsinc.com/data/mathewsinc/file/245_44305_NorAmerHunterMathews2009NewProducts.pdf.

Murray, Jeff; Mathews is Unbearish for 2009; Bear Hunting Magazine (Jan./Feb. 2009); http://mathewsinc.com/data/mathewsinc/file/245_44237_Mathews-Murray.pdf.

Mathews, Inc.; magazine ad copy (believed published in 2009); http://mathewsinc.com/data/mathewsinc/file/245_44993_monster_full-boww-lrz.pdf.

* cited by examiner

CABLE TAKE-UP OR LET-OUT MECHANISM FOR A COMPOUND ARCHERY BOW

BACKGROUND

The field of the present invention relates to archery bows. In particular, a compound archery bow is described herein wherein a power cable take-up mechanism has an effective lever arm that decreases to a distance less than the axle radius during a latter portion of drawing the bow.

For purposes of the present disclosure and appended claims, the terms "compound archery bow" or "compound bow" shall denote an archery bow that uses a levering system, usually comprising one or more cables and pulleys, to bend the limbs as the bow is drawn. Examples of compound bows include dual-cam bows (including those that employ a Binary Cam System®), hybrid-cam bows, or single-cam bows. Many compound archery bows typically include one or more power cables (sometimes referred to as buss cables or anchor cables). Conventionally, each power cable is engaged at its first end to be taken up by a power cam (or other take-up mechanism) of a pulley member rotatably mounted on one bow limb, and is coupled at its second end to the other bow limb (in some cases a fixed connection, and in other cases including a mechanism for taking-up and/or letting-out the second end of the power cable). Tension developed as the bow is drawn and the power cable is taken up causes deformation of the bow limbs and storage of potential energy therein. A portion of that potential energy is transformed into the kinetic energy of the arrow shot by the bow. A few examples of various compound bow types are disclosed in the following patents and application, all of which are incorporated by reference as if fully set forth herein:

U.S. Pat. No. 3,990,425 entitled "Compound bow" issued Nov. 9, 1976 to Ketchum;

U.S. Pat. No. 4,686,955 entitled "Compound archery bows" issued Aug. 18, 1987 to Larson;

U.S. Pat. No. 5,368,006 entitled "Dual-feed single-cam compound bow" issued Nov. 29, 1994 to McPherson;

U.S. Pat. No. 6,871,643 entitled "Eccentric elements for a compound archery bow" issued Mar. 29, 2005 to Cooper et al;

U.S. Pat. No. 6,990,970 entitled "Compound archery bow" issued Jan. 31, 2006 to Darlington;

U.S. Pat. No. 7,305,979 entitled "Dual-cam archery bow with simultaneous power cable take-up and let-out" issued Dec. 11, 2007 to Yehle;

U.S. Pat. No. 7,441,555 entitled "Synchronized compound archery bow" issued Oct. 28, 2008 to Larson;

U.S. non-provisional application Ser. No. 12/511,085 entitled "Pulley-and-cable power cable tensioning mechanism for a compound archery bow" filed Jul. 29, 2009 in the name of Craig T. Yehle; and U.S. non-provisional application Ser. No. 12/690,783 entitled "Eccentric power cable let-out mechanism for a compound archery bow" filed Jan. 20, 2010 in the name of Craig T. Yehle.

SUMMARY

A compound archery bow comprises: a substantially rigid riser; first and second resilient bow limbs extending from respective end portions of the riser; first and second pulley members connected to the respective bow limbs; a draw cable; and a power cable. The first pulley member rotates relative to the first bow limb around a first rotation axis, and includes a first draw cable journal, a power cable take-up mechanism, and first and second axle segments arranged to extend from opposite sides of the first pulley member. The second pulley member rotates relative to the second bow limb around a second rotation axis, and includes a second draw cable journal. The draw cable is engaged with the first and second draw cable journals and is arranged to rotate the first and second pulley members as the bow is drawn and the draw cable is let out from the first draw cable journal. The power cable is engaged to be taken up by the power cable take-up mechanism as the bow is drawn and the first pulley member rotates. The axle segments are substantially coaxial with the first rotation axis and rotatably connect the first pulley member to a corresponding portion of the first bow limb. The first pulley member is arranged so that an effective lever arm of the power cable take-up mechanism decreases, during a latter portion of drawing the bow, from a distance that is greater than a radius of the axle segments to a minimum distance that is less than that radius. The first pulley member is further arranged so that, with the bow fully drawn, at least a portion of the power cable passes through at least a portion of a space between the first and second axle segments.

Objects and advantages pertaining to compound archery bows may become apparent upon referring to the exemplary embodiments illustrated in the drawings and disclosed in the following written description or claims.

The embodiments shown in the Figures are exemplary, and should not be construed as limiting the scope of the present disclosure or appended claims. The Figures may illustrate the exemplary embodiments in a schematic fashion, and various shapes, sizes, angles, curves, proportions, and so forth may be distorted to facilitate illustration. The specific shapes, sizes, angles, curves, proportions, etc should not be construed as limiting the scope of the present disclosure or appended claims.

DETAILED DESCRIPTION OF EMBODIMENTS

Figure 1:
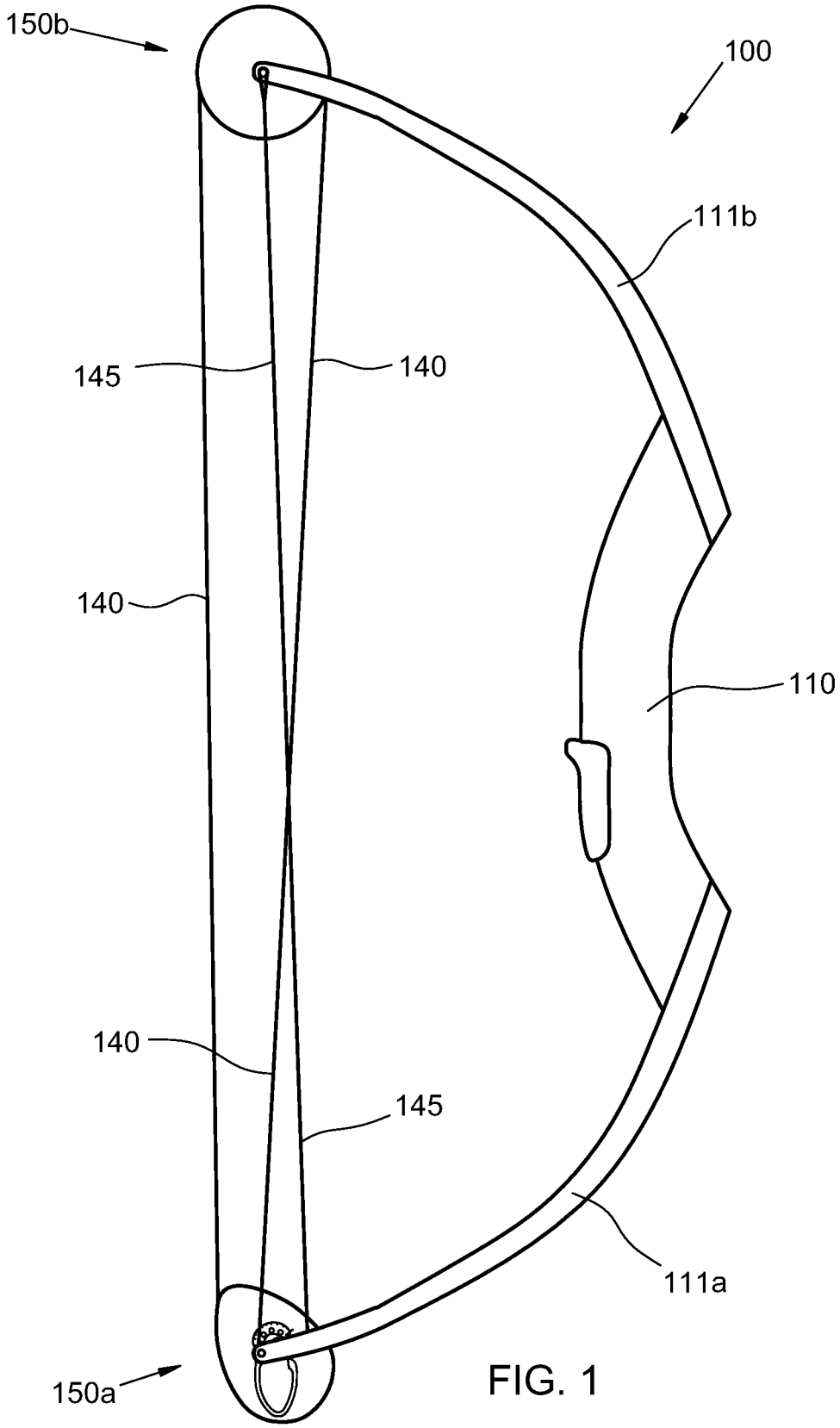
FIG. 1 illustrates schematically an exemplary single-cam compound archery bow.

An exemplary compound archery bow 100 is illustrated schematically in FIG. 1; the corresponding pulley member 150*a* (e.g., a cam assembly) is shown enlarged in FIGS. 2A-2D, 3A, and 3B. The exemplary archery bow 100 is a single-cam bow, and the second pulley member 150*b* comprises an idler wheel. In a hybrid cam bow, pulley member 150*b* might comprise one or more concentric or eccentric wheels or cams (not shown), one for letting out the draw cable 140 and the other for taking up a secondary cable (not shown) let-out from a journal 156*a* of the pulley member 150*a*. The pulley members 150*a* and 150*b* are rotatably connected to respective resilient bow limbs 111*a* and 111*b* and rotate about respective rotation axes. Both eccentrically and concentrically mounted wheels, pulleys, or cams shall fall within the scope of the present disclosure or appended claims. The limbs 111*a* and 111*b* extend from respective ends of a substantially rigid riser 110, which includes a handle of any suitable type. The riser 110 and limbs 111*a* and 111*b* can be of any suitable construction or arrangement. Draw cable 140 is engaged with the pulley member 150*a* in a draw cable journal 152*a*, passes around pulley member 150*b* in its journal 152*b*, and is engaged with the let-out journal 156*a* of pulley member 150*a*. When the bow is drawn, the draw cable 140 unwinds from the draw cable journal 152*a* and the let-out journal 156*a*, thereby rotating the pulley members 150*a* and 150*b*.

A power cable 145 is engaged to be taken up by a power cable take-up mechanism of pulley member 150*a* as the bow 100 is drawn and the pulley member 150*a* rotates. The power cable 145 is shown in FIG. 1 to be secured to the bow limb 111*b* by being looped around the axle of pulley member 150*b*. Alternatively, the power cable can be connected or coupled to the bow limb 111*b* through a mechanism that takes-up and/or lets-out the power cable 145 as the bow 100 is drawn and the pulley member 150*a* rotates, as described in several of the references incorporated above. Any suitable connection or coupling of the power cable 145 to the bow limb 111*b* shall fall within the scope of the present disclosure or appended claims. In the example of FIG. 1, the power cable take-up mechanism of pulley member 150*a* is an eccentric power cable take-up journal 154*a*. Any suitable take-up mechanism (e.g., a concentric or eccentric journal, a series of posts around which the power cable is wound, or an eccentrically positioned power cable anchor) can be employed within the scope of the present disclosure or appended claims. Take-up of the power cable 145 as the bow is drawn and the pulley member 150*a* rotates generates tension in the power cable that results in deformation of the bow limbs 111*a* and 111*b*. That deformation stores energy that is transferred to an arrow when the draw cable 140 is released to shoot the arrow with the bow.

The power cable take-up mechanism in a compound archery bow is typically arranged to provide a significant "let-off" (i.e., decrease) of the force required to pull back the draw cable 140 when drawing the bow. The smaller the draw force required at full draw, the greater the let-off (generally expressed as a percent reduction of the peak draw force; therefore, a greater percent let-off corresponds to a smaller draw force required at full draw). The pulley member 150*a* and its corresponding power cable take-up mechanism (e.g., power cable take-up journal 154*a*) are typically arranged so that the let-off occurs somewhat abruptly at a draw distance suitable for a given user of the bow (usually referred to as "full draw"). A pulley member 150*a* can in some instances be adjusted to provide differing draw lengths for a given bow.

One way in which the let-off is provided is by a decrease in the effective lever arm of the power cable take-up mechanism. For purposes of the present disclosure and appended claims, the effective lever arm of a journal, cam, or other take-up or let-out mechanism is the perpendicular distance from the rotation axis of the corresponding pulley member to the inside edge of a cable's tangent point. More accurately, a decrease in the effective lever arm of the power cam take-up mechanism relative to the effective lever arm of the draw cable journal determines the let-off of a given bow. In most instances, the effective lever arm of a power cable take-up mechanism decreases during a latter portion of drawing the bow, and that decrease provides a mechanical advantage that reduces the force required to pull the draw cable and rotate the pulley member 150*a* (i.e., provides the let-off).

In a conventional compound bow, a minimum practicable effective lever arm is about equal to the radius of an axle used to mount the pulley member 150*a*. Once that minimum is reached, any further let-off can be achieved only by further increasing the effective lever arm of the draw cable journal 152*a*. However, increasing the draw cable journal effective lever arm has other undesirable effects, including the increased size and mass of the pulley member 150*a* and a reduction of the energy that can be stored in the bow limbs 111*a* and 111*b* by rotation of the pulley member 150*a*.

The pulley member 150*a* according to the present disclosure (for the exemplary single-cam compound bow 100) comprises first and second axle segments 158*a*, a draw cable journal 152*a*, a power cable take-up mechanism (in this example a power cable take-up journal 154*a*), and a secondary cable let-out mechanism (in this example a secondary cable let-out journal 156*a*). The first and second substantially coaxial axle segments 158*a* are arranged to extend from opposite sides of the pulley member 150*a* and to rotatably connect the pulley member to the bow limb 111*a*. The first and second axle segments 158*a* are substantially coaxial and substantially define the rotation axis of the pulley member 150*a* relative to the bow limb 111*a*. The draw cable journal 152*a* is connected to the axle segments 158*a* and is arranged to let out the draw cable 140 as the bow 100 is drawn and the pulley member 150*a* rotates about its rotation axis. The secondary cable let-out journal 156*a* is arranged to engage a secondary cable (in this instance the other end of the draw cable 140 after it passes over the idler wheel 150*b*) and to let out the secondary cable as the bow 100 is drawn and the pulley member 150*a* rotates. The power cable take-up journal 154*a* is arranged to take up the power cable 145 as the bow 100 is drawn and the pulley member 150*a* rotates. The other end of the power cable 145 is secured to an axle of the idler wheel 150*b*, but could alternatively be connected or coupled to bow limb 111*b* by any suitable let-out and/or take-up mechanism, as disclosed in various of the references cited above.

Figure 2B:
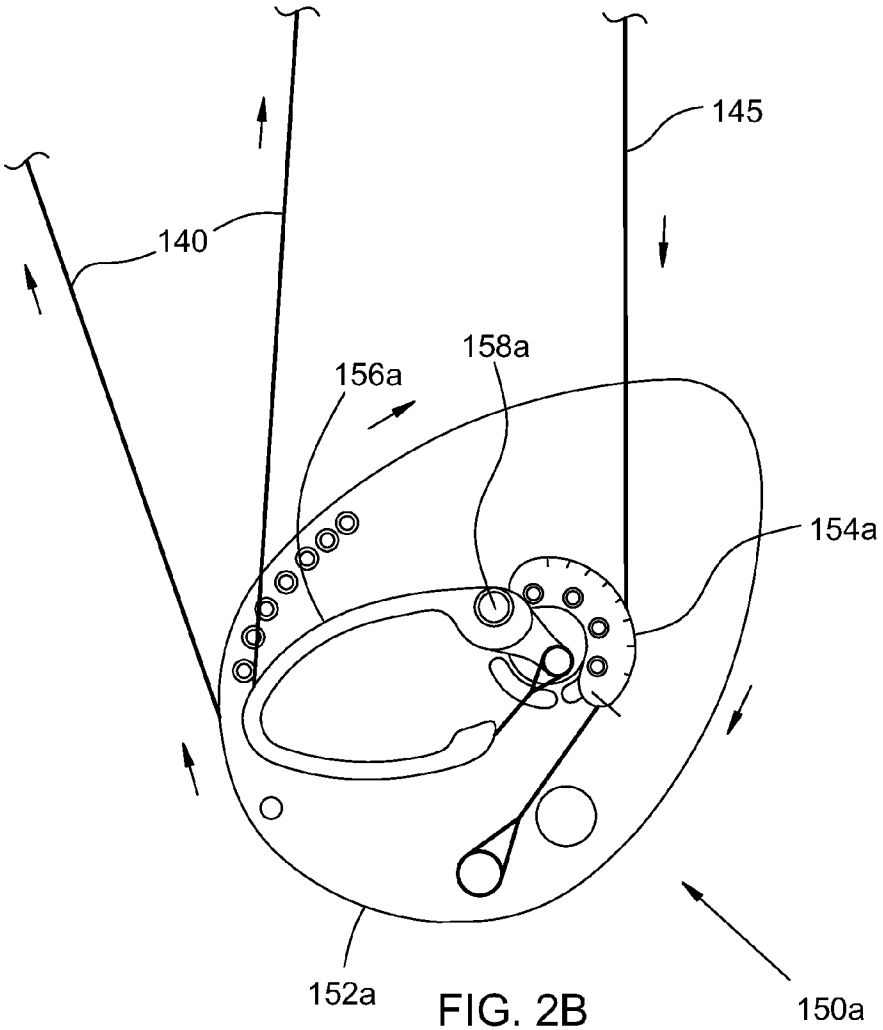
FIGS. 2A-2C, 2D, and 3A-3B are schematic side, cross-sectional, and top views of a pulley member of the bow of FIG. 1.
Figure 2A:
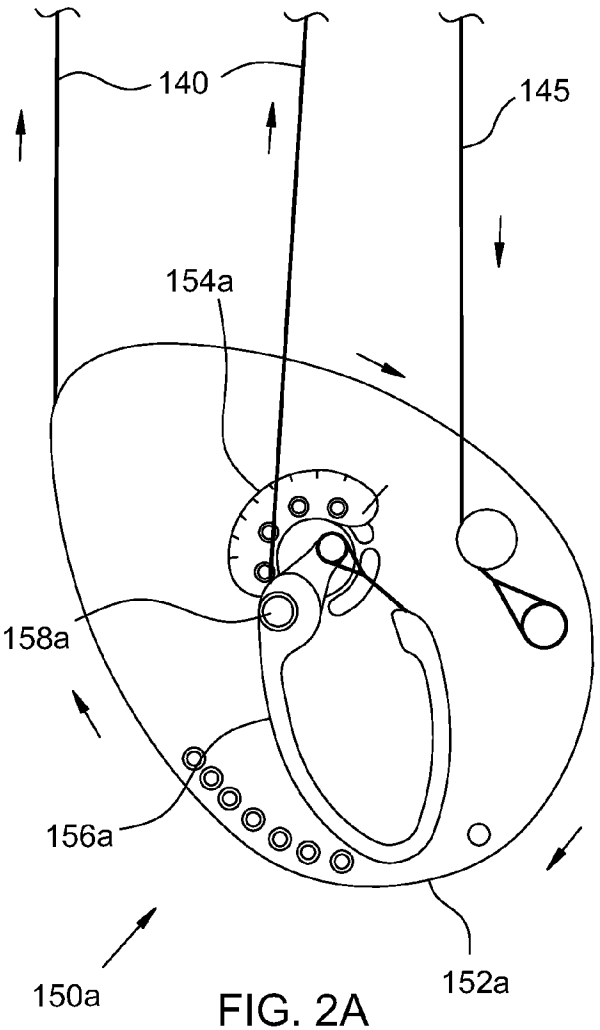
Figure 2D:
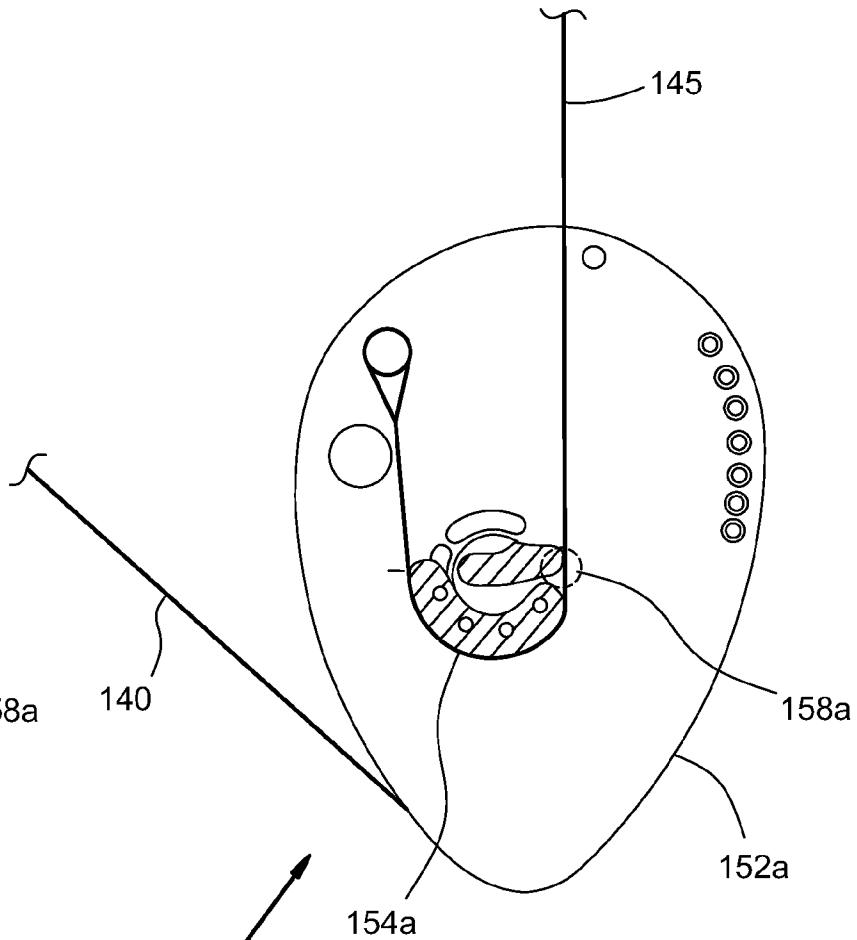
Figure 2C:
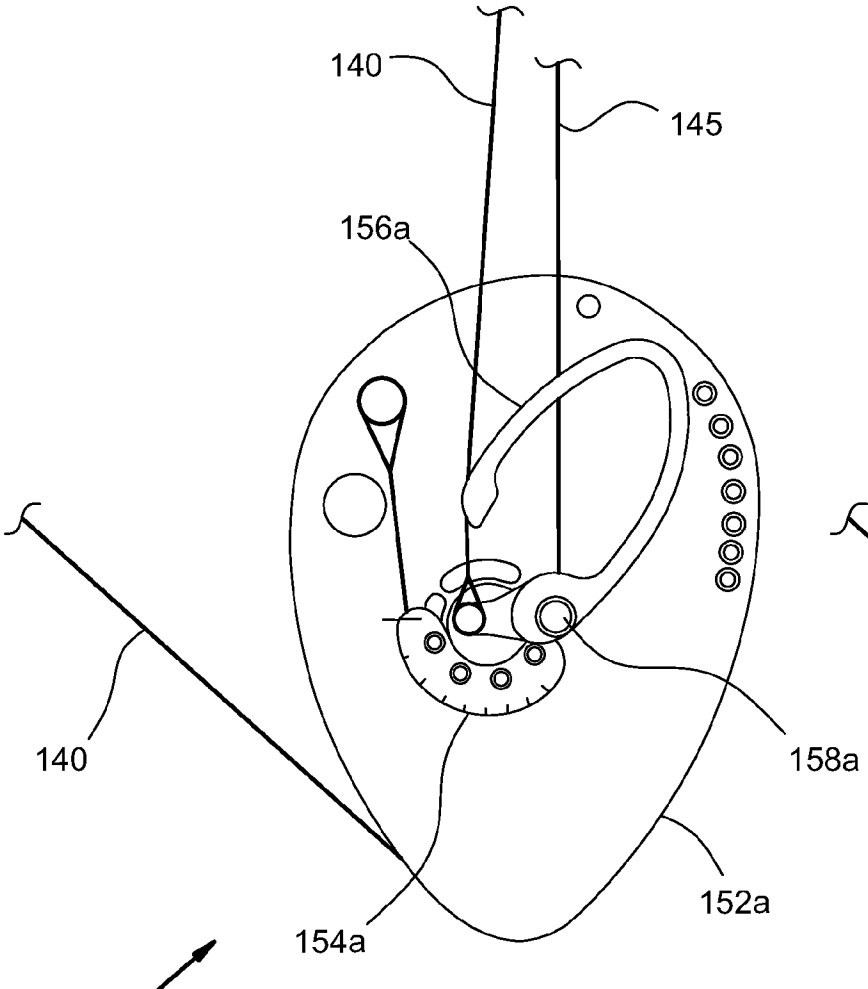
Figure 3B:
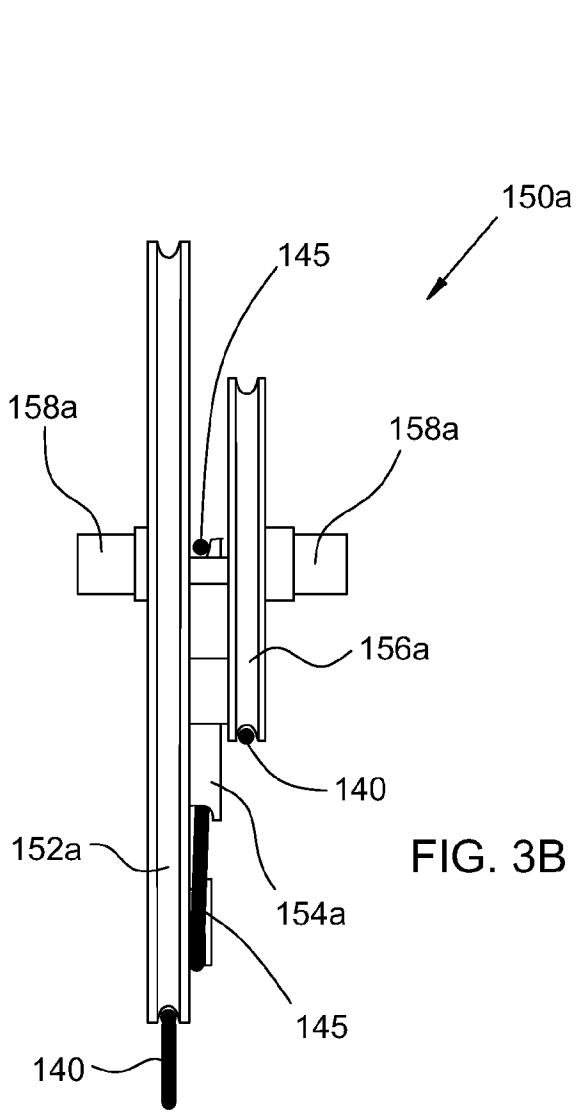
Figure 3A:
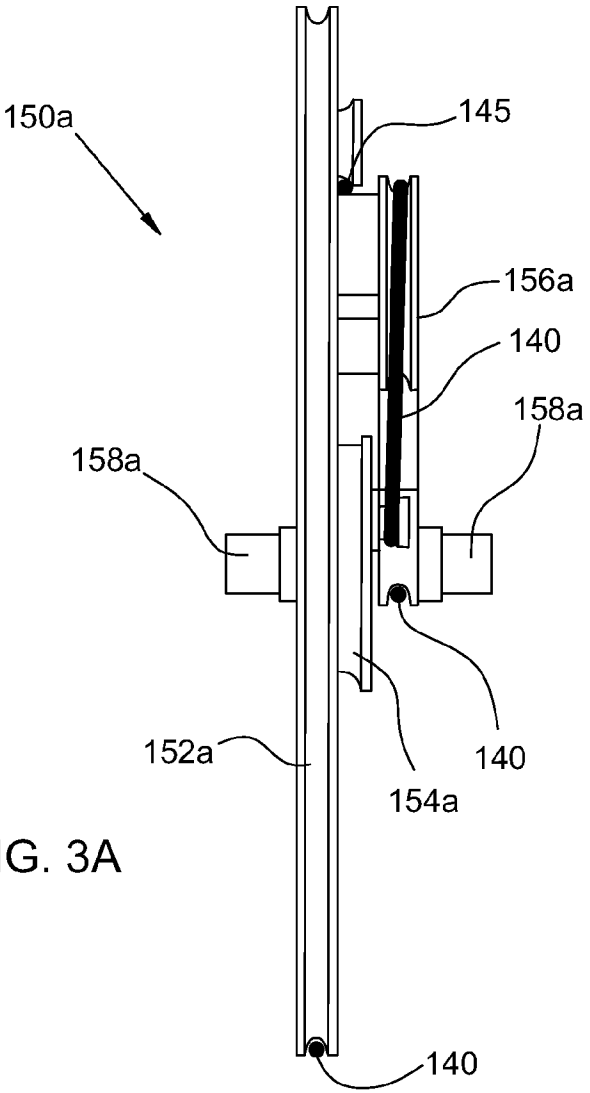

The pulley member 150*a* is arranged so that the effective lever arm of the power cable take-up journal 154*a* decreases during a latter portion of drawing the bow 100, from a distance that is greater than a radius of the axle segments (as in FIGS. 2A, 2B, and 3A) to a minimum distance that is less than that radius (as in FIGS. 2C, 2D, and 3B). That arrangement is possible because the axle segments 158*a* are not fully contiguous with one another. At least a portion of the space between the axle segments 158*a* is empty (for example, by machining an eccentric slot into one side of what would otherwise have constituted a central portion of a single, contiguous axle), so that with the bow 100 fully drawn, at least a portion of the power cable 145 passes through at least a portion of a space between the first and second axle segments 158*a*, reducing the effective lever arm to a distance less than the radius of the axle segments 158*a*. This is most clearly illustrated in FIG. 3B (a view looking along the power cable 145 at the pulley member 150*a* with the bow at full draw) and FIGS. 2C and 2D (side and cross-sectional views, respectively, of the pulley member 150*a* with the bow 100 at full draw).

Any suitable dimensions can be employed for the radius of the axle segments 158*a* and for the minimum distance between the power cable 145 and the rotation axis at full draw. The forces typically exerted on the axle segments 158*a* and available or suitable materials may dictate a minimum radius to be employed for the axle segments (to provide sufficient mechanical strength). The axle segments 158*a* can comprise separate components mounted, assembled, or connected to the pulley member 150*a*, or can comprise integrally formed parts of the pulley member 150*a*. In one example, the entire pulley member 150*a* is machined from a single piece of aluminum, and the axle segments 158*a* are integrally formed and are about 4 mm in radius (about 8 mm in diameter). In various other examples, the axle segments 158*a* can be less than about 6 mm in radius, less than about 5 mm, less than about 4 mm, less than about 3 mm, or even less than about 2 mm in radius. In still other various examples, the axle segments can be greater than about 1 mm in radius, greater than about 2 mm, greater than about 3 mm, greater than about 4 mm, greater than about 5 mm, or even greater than about 6 mm in radius.

The minimum distance between the power cable and the rotation axis at full draw (i.e., the minimum effective lever arm at full draw) is less than the radius of the corresponding axle segments 158*a*. How much less determines in part the let-off that can be achieved with a given draw cable journal 152*a*. In the integrally formed, aluminum example described above, the minimum effective lever arm is about 0.5 mm at full draw (i.e., about ⅛ the size of the axle segment radius, which would decrease the required draw force by about a factor of 8, all other things being equal). In various other examples, the minimum effective lever arm can be greater than about 0.5 mm, greater than about 1 mm, greater than about 2 mm, greater than about 3 mm, or greater than about 4 mm. In still other various examples, the minimum effective lever arm can be less than about 4 mm, less than about 3 mm, less than about 2 mm, or less than about 1 mm.

The ratio of the axle segment radius to the minimum effective lever arm is greater than 1:1. In the integrally formed, aluminum example described above, that ratio is about 8:1. In various other examples, that ratio can be greater than about 1.5:1, greater than about 2:1 greater than about 3:1, greater than about 4:1, greater than about 5:1, greater than about 6:1, greater than about 8:1, or even greater than about 10:1. In still other examples, the ratio can be less than about 10:1, less than about 8:1, less than about 6:1, less than about 5:1, less than about 4:1, less than about 3:1, or less than about 2:1.

The preceding are exemplary values that yield satisfactory bow performance, however, other values for the axle segment radius, minimum take-up lever arm, or ratio, including values outside the exemplary ranges, can be employed while remaining within the scope of the present disclosure or appended claims. As stated earlier, any suitable combination of dimensions or ratio can be employed to achieve a desired degree of let-off for a given pulley member 150*a*.

Preferably, the pulley member should be arranged so that the power cable does not pass "over center" (i.e., the minimum effective lever arm should not go through zero and become "negative"). If such an "over center" arrangement were permitted, the bow could exhibit 100% let-off or "cocking," in which the draw cable goes limp and the bow limbs are stuck in their deformed state. Releasing the draw cable at this point does not shoot the arrow; instead the pulley members must be mechanically forced (preferably using a bow press for safety) back past the 100% let-off position. The first pulley member is preferably arranged so as to avoid 100% let-off of the draw force or so as to prevent cocking of the bow, e.g., by ensuring that material comprising the power cable journal or the axle segments occupies at least a minimal volume between the axle segments 158*a* that includes the rotation axis. Such an arrangement could prevent the power cable from passing "over center."

Another arrangement for avoiding the cocked bow, 100% let-off scenario is use of a rotation stop (not shown) on the pulley member 150*a*, as disclosed in, e.g., U.S. Pat. No. 7,305,979. Such a rotation stop can comprise, for example, a simple peg or other protrusion secured to the pulley member so that, upon rotation, the stop eventually comes into contact with a bow limb, the draw cable, or a power cable to hinder or prevent further rotation of the pulley member. Such a rotation stop can be secured to the respective pulley member at a position chosen to limit its rotation to a desired value. The rotation limit can be chosen for yielding a desired let-off or avoiding 100% let-off, for yielding a desired draw length, or for another purpose. The rotation stop can be integrally formed with or permanently secured to the cam assembly. Alternatively, the rotation stop can be adjustably secured to the pulley member by means of a slot or other suitable adjustable attachment.

In some examples of a single-cam or hybrid-cam compound bow, it may be desirable to decrease the effective lever arm of the let-out journal 156*a* to a distance smaller than the radius of the axle segments 158*a*. In that event, a corresponding portion of the space between the axle segments 158*a* can be adapted in a manner similar to that described above for the power cable journal 154*a*. That arrangement is most clearly seen in FIGS. 2A and 3A. The pulley member 150*a* is arranged so that an effective lever arm of the secondary cable let-out journal 156*a* increases, during an initial portion of drawing the bow 100, from a minimum distance that is less than a radius of the axle segments 158*a* to a distance that is greater than that radius. Dimensional and ratios similar to those given above for the take-up journal 154*a* can be employed for the let-out journal 156*a*.

Figure 4:
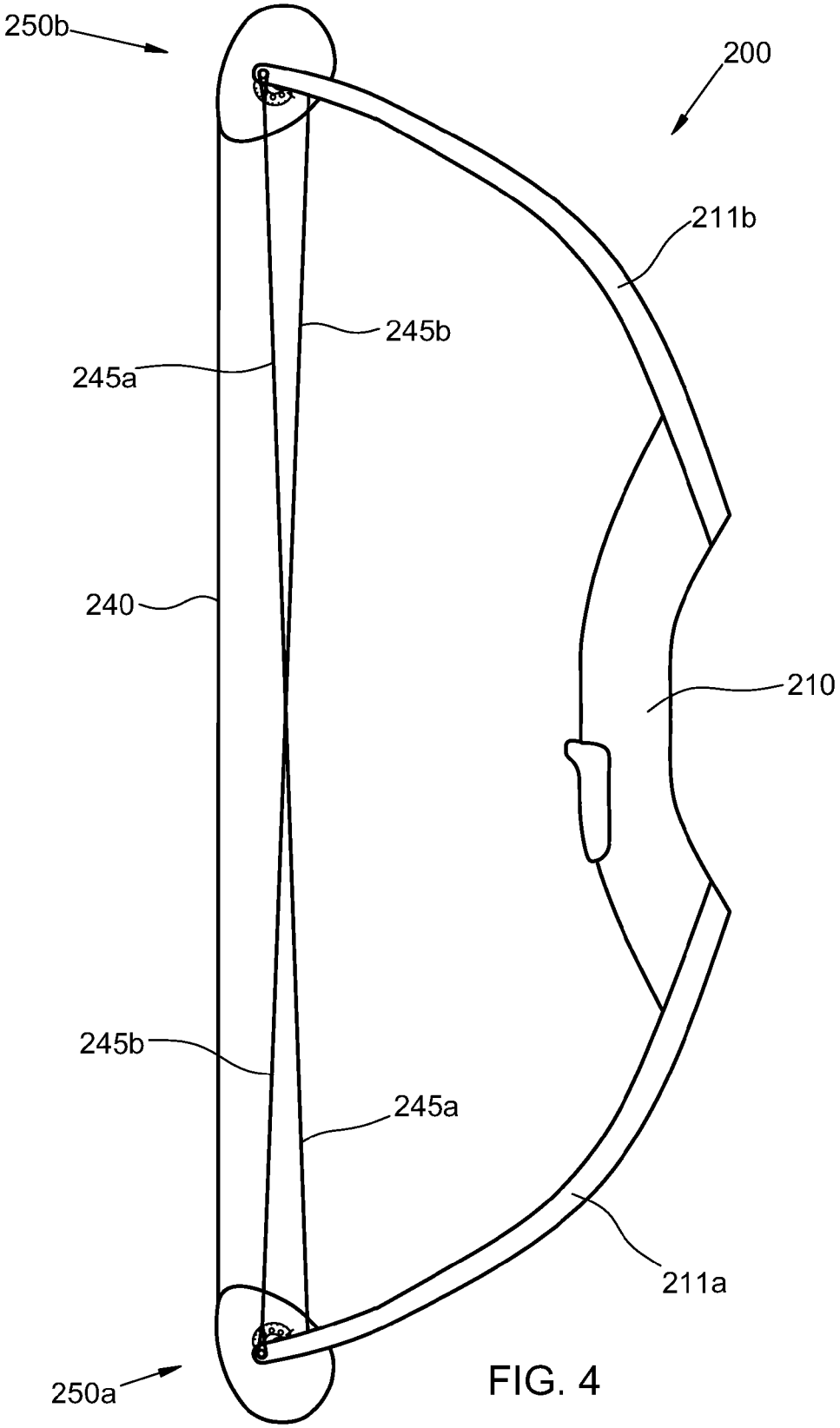
FIG. 4 illustrates schematically an exemplary dual-cam compound archery bow.
Figure 5B:
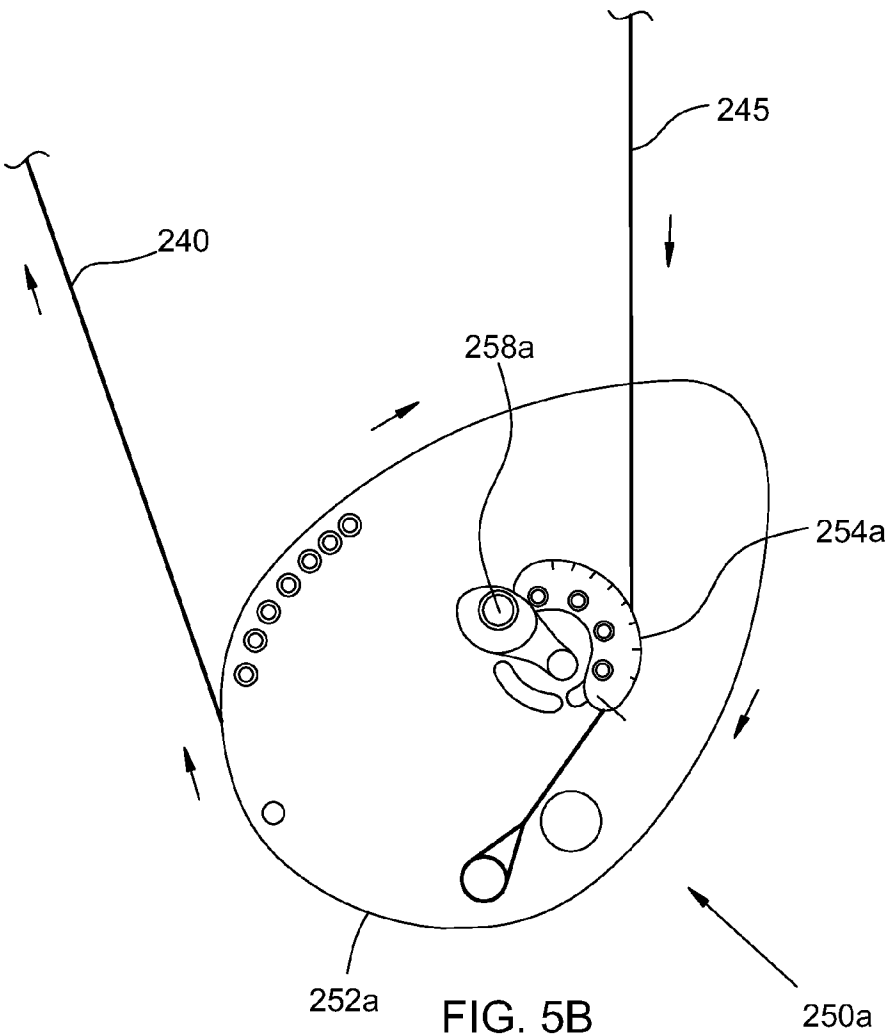
FIGS. 5A-5C, 5D, and 6A-6B are schematic side, cross-sectional, and top views of a pulley member of the bow of FIG. 4.
Figure 5A:
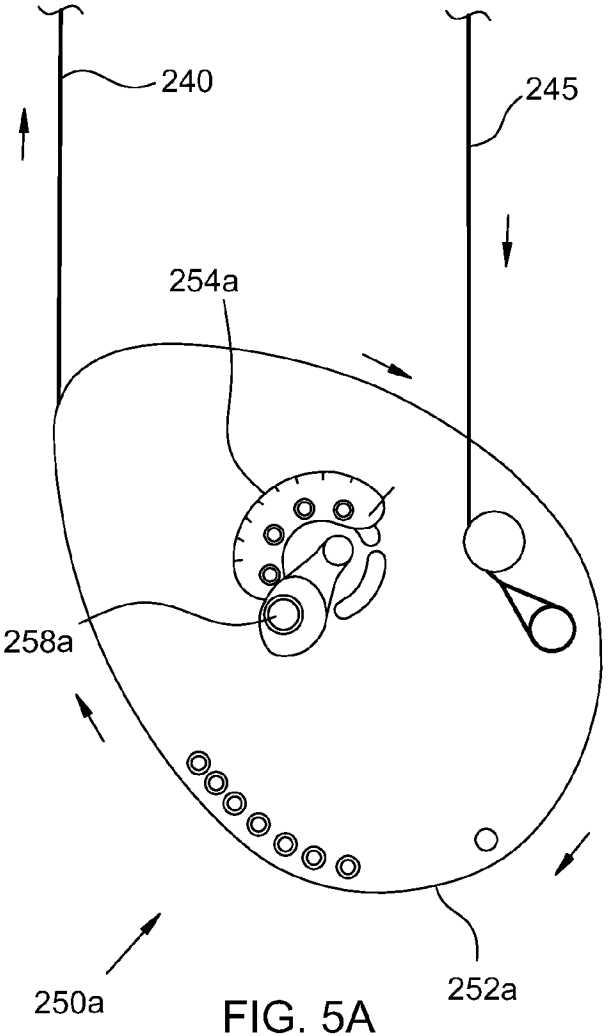
Figure 5D:
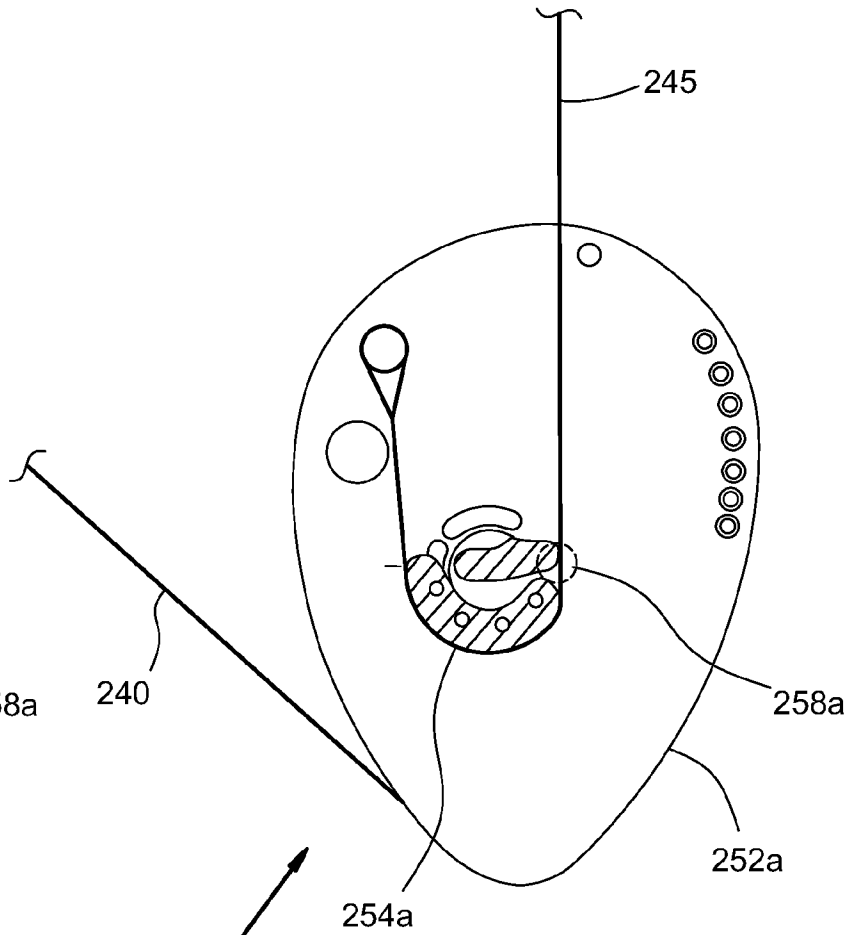
Figure 5C:
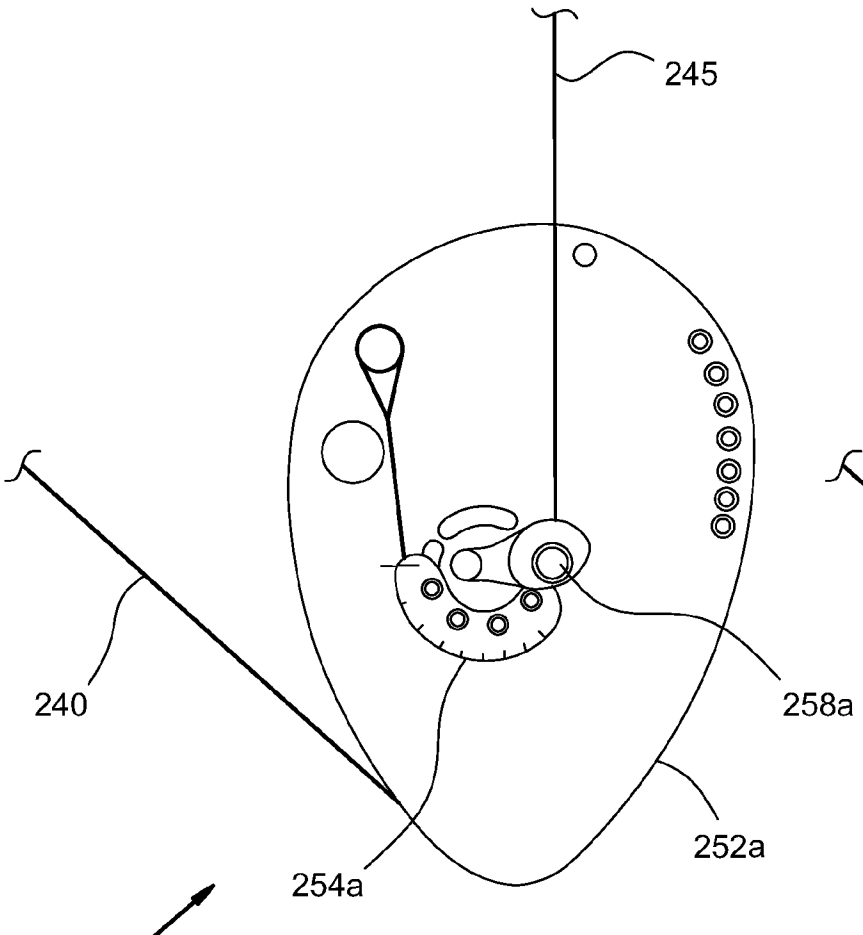
Figure 6B:
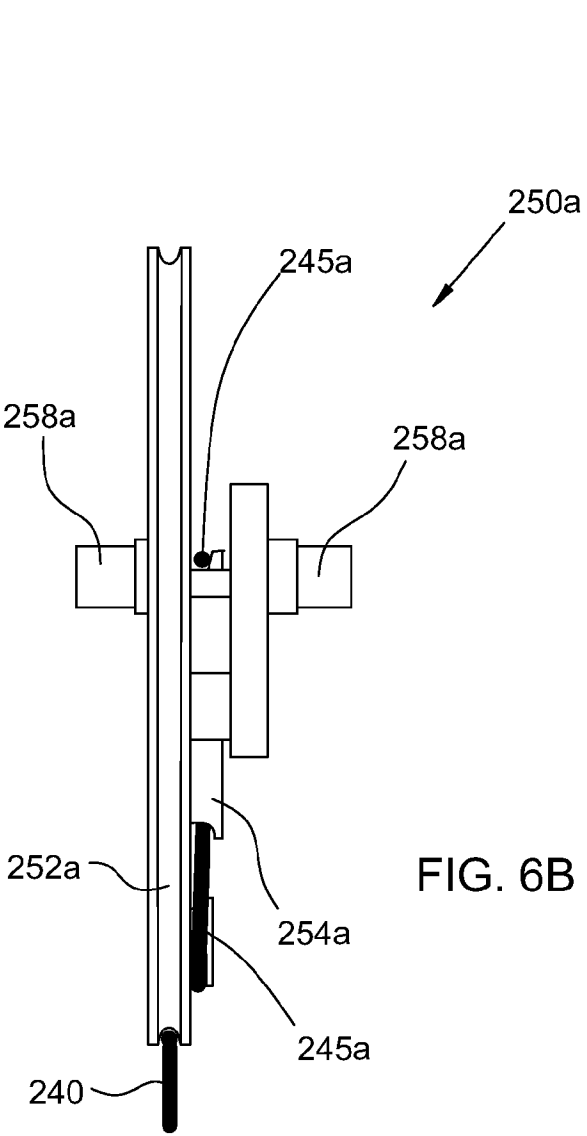
Figure 6A:
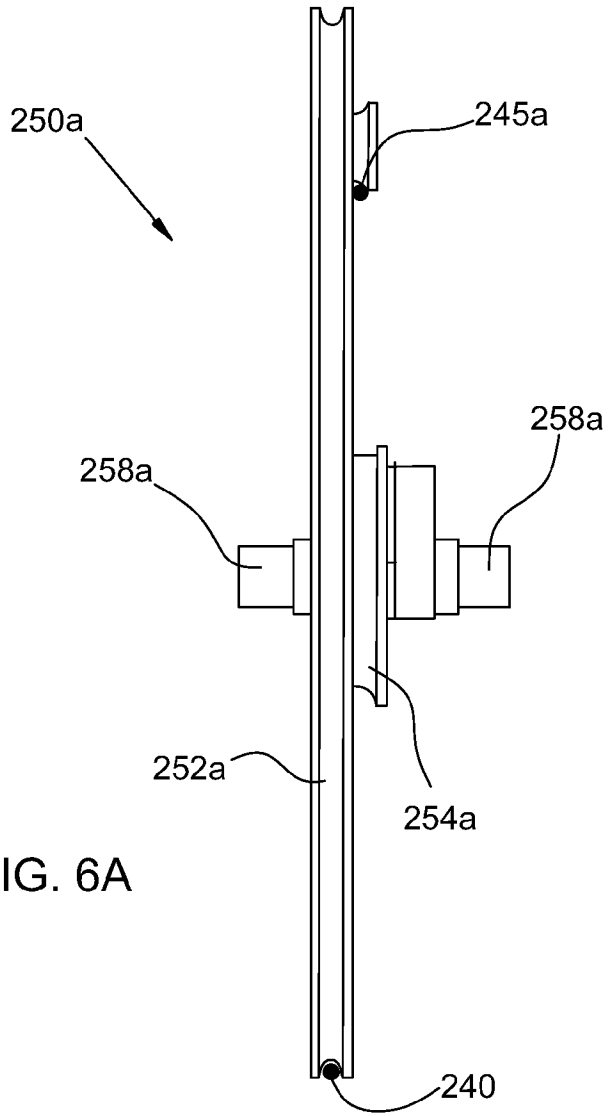

A second exemplary compound archery bow 200 is illustrated schematically in FIG. 4; the corresponding pulley member 250*a* (e.g., a cam assembly) is shown enlarged in FIGS. 5A-5D, 6A, and 6B (arranged analogously to FIGS. 2A-2D, 3A, and 3B). The exemplary archery bow 200 is a dual-cam bow, and the second pulley member 250*b* typically is substantially identical to pulley member 250*a*, or its substantial mirror image (i.e., symmetric cams), though this need not always be the case. Both symmetric and asymmetric embodiments shall fall within the scope of the present disclosure or appended claims. The pulley members 250*a* and 250*b* are rotatably connected to respective resilient bow limbs 211*a* and 211*b* and rotate about respective rotation axes. Both eccentrically and concentrically mounted wheels, pulleys, or cams shall fall within the scope of the present disclosure or appended claims. The limbs 211*a* and 211*b* extend from respective ends of a substantially rigid riser 210, which includes a handle of any suitable type. The riser 210 and limbs 211*a* and 211*b* can be of any suitable construction or arrangement. Draw cable 240 is engaged with the pulley members 250*a* and 250*b* in corresponding draw cable journals 252*a* and 252*b*. When the bow is drawn, the draw cable 240 unwinds from the draw cable journals 252*a* and 252*b*, thereby rotating the pulley members 250*a* and 250*b*.

A power cable 245*a* is engaged to be taken up by a power cable take-up mechanism of pulley member 250*a* as the bow 200 is drawn and the pulley member 250*a* rotates. A power cable 245*b* is similarly engaged to be taken up by a power cable take-up mechanism of pulley member 250*b*. The power cables 245*a* and 245*b* are shown in FIG. 4 to be secured to the bow limbs 211*b* and 211*a*, respectively, by being looped around the axle of the corresponding pulley members 250*b* and 250*a*. Alternatively, the power cables can be connected or coupled to the bow limbs 211*a* and 211*b* through mechanisms that take-up and/or let-out the power cables 245*a* and 245*b* as the bow 200 is drawn and the pulley members 250*a* and 250*b* rotate, as described in several of the references incorporated above. Any suitable connection or coupling of the power cables 245*a* and 245*b* to the respective bow limbs 211*b* and 211*a* shall fall within the scope of the present disclosure or appended claims. In the example of FIG. 4, the power cable take-up mechanisms of the pulley members 250*a* and 250*b* are eccentric power cable take-up journals 254*a* and 245*b*, respectively. Any suitable take-up mechanism (e.g., a concentric or eccentric journal, a series of posts around which the power cable is wound, or an eccentrically positioned power cable anchor) can be employed within the scope of the present disclosure or appended claims. Take-up of the power cables 245*a* and 245*b* as the bow is drawn and the pulley members 250*a* and 250*b* rotate generates tension in the power cables that results in deformation of the bow limbs 211*a* and 211*b*, as described above.

The pulley members 250*a* and 250*b* substantially resemble pulley member 150*a* with respect to function and arrangement of the draw journals 252*a* and 252*b*, the power cable take-up journals 254*a* and 254*b*, and the axle segments 258*a* and 258*b*. The following description refers only to pulley member 250*a*, but applies equally to pulley member 250*b*. The pulley member 250*a* is arranged so that the effective lever arm of the power cable take-up journal 254*a* decreases during a latter portion of drawing the bow 200, from a distance that is greater than a radius of the axle segments 258*a* (as in FIGS. 5A, 5B, and 6A) to a minimum distance that is less than that radius (as in FIGS. 5C, 5D, and 6B). That arrangement is possible because the axle segments 258*a* are not fully contiguous with one another. At least a portion of the space between the axle segment 258*a* is empty (for example, by machining an eccentric slot into one side of what would otherwise have constituted a central portion of a single contiguous axle), so that with the bow 200 fully drawn, at least a portion of the power cable 245*a* passes through at least a portion of a space between the first and second axle segments 258*a*, reducing the effective lever arm to a distance less than the radius of the axle segments 258*a*. This is most clearly illustrated in FIG. 6B (a view looking along the power cable 145 at the pulley member 150*a* with the bow at full draw) and FIGS. 5C and 5D (side and cross-sectional views, respectively, of the pulley member 550*a* with the bow 200 at full draw).

The various examples of dimensions and ratios given above for pulley member 150*a* can be employed for pulley members 250*a* and 250*b* as well. Various arrangements described above for avoiding a 100% let-off, cocked-bow scenario for bow 100 can be employed for bow 200 as well.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description, various features may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure shall also be construed as implicitly disclosing any embodiment having any suitable combination of disclosed or claimed features (i.e., combinations of features that are not incompatible or mutually exclusive) that appear in the present disclosure or the appended claims, including those combinations of features that may not be explicitly disclosed herein. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶ 6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶ 6 are not intended to be invoked for that claim.

What is claimed is:

1. A compound archery bow comprising:

a substantially rigid riser;

a first resilient bow limb extending from a first end portion of the riser;

a second resilient bow limb extending from a second end portion of the riser;

a first pulley member connected to the first bow limb and rotatable relative to the first bow limb around a first rotation axis, which first pulley member includes a first draw cable journal, a power cable take-up mechanism, and first and second axle segments arranged to extend from opposite sides of the first pulley member;

a second pulley member connected to the second bow limb and rotatable relative to the second bow limb around a second rotation axis, which second pulley member includes a second draw cable journal;

a draw cable engaged with the first and second draw cable journals and arranged to rotate the first and second pulley members as the bow is drawn and the draw cable is let out from the first draw cable journal; and a power cable engaged to be taken up by the power cable take-up mechanism as the bow is drawn and the first pulley member rotates, wherein:

the axle segments are substantially coaxial with the first rotation axis, and rotatably connect the first pulley member to a corresponding portion of the first bow limb;

the first pulley member is arranged so that an effective lever arm of the power cable take-up mechanism decreases, during a latter portion of drawing the bow, from a distance that is greater than a radius of the axle segments to a minimum distance that is less than that radius; and the first pulley member is further arranged so that, with the bow fully drawn, at least a portion of the power cable passes through at least a portion of a space between the first and second axle segments.

2. The bow of claim 1 wherein the radius of the first and second axle segments is less than about 4 mm.

3. The bow of claim 1 wherein and the minimum distance is greater than about 0.5 mm.

4. The bow of claim 1 wherein a ratio of the radius of the first and second axle segments to the minimum distance is greater than about 2:1.

5. The bow of claim 1 wherein a ratio of the radius of the first and second axle segments to the minimum distance is greater than about 4:1.

6. The bow of claim 1 wherein the first pulley member is arranged so as to avoid 100% let-off of the draw force or so as to prevent cocking of the bow.

7. The bow of claim 1 wherein the power cable take-up mechanism comprises a power cable take-up journal non-rotatably connected to the draw cable journal.

8. The bow of claim 1 wherein:

the second pulley member further includes a corresponding power cable take-up mechanism, and corresponding first and second axle segments arranged to extend from opposite sides of the second pulley member;

the bow further comprises a second power cable engaged to be taken up by the power cable take-up mechanism of the second pulley member as the bow is drawn and the second pulley member rotates;

the axle segments of the second pulley member are substantially coaxial with the second rotation axis and rotatably connect the second pulley member to a corresponding portion of the second bow limb; and the second pulley member is arranged so that an effective lever arm of its power cable take-up mechanism decreases during a latter portion of drawing the bow from a distance that is greater than a radius of the corresponding axle segments to a minimum distance that is less than that radius; and the second pulley member is further arranged so that, with the bow fully drawn, at least a portion of the second power cable passes through at least a portion of a space between the corresponding first and second axle segments.

9. The bow of claim 8 wherein the first and second pulley members are substantially identical or substantial mirror images of one another.

10. The bow of claim 8 wherein the first and second pulley members are arranged so as to avoid 100% let-off of the draw force or so as to prevent cocking of the bow.

11. The bow of claim 1 wherein:

the bow further comprises a secondary cable that is engaged with the first and second pulley members and arranged to be let out by the first pulley member and taken up by the second pulley member as the bow is drawn; and the first pulley member further includes a secondary cable let-out mechanism, non-rotatably connected to the draw cable journal, that engages the secondary cable.

12. The bow of claim 11 wherein the first pulley member is arranged so that an effective lever arm of the secondary cable let-out mechanism increases, during an initial portion of drawing the bow, from a minimum distance that is less than a radius of the axle segments to a distance that is greater than that radius.

13. A pulley member for a compound archery bow, the pulley member comprising:

first and second substantially coaxial axle segments arranged to extend from opposite sides of the pulley member and to rotatably connect the pulley member to a bow limb of a compound archery bow, which axle segments substantially define a rotation axis of the pulley member relative to the bow limb;

a draw cable journal connected to the axle segments and arranged to let out a draw cable as the bow is drawn and the pulley member rotates about the rotation axis; and a power cable take-up mechanism arranged to take up a power cable as the bow is drawn and the pulley member rotates about the rotation axis, wherein:

the pulley member is arranged so that an effective lever arm of the power cable take-up mechanism decreases during a latter portion of drawing the bow from a distance that is greater than a radius of the axle segments to a distance that is less than that radius; and the pulley member is further arranged so that, with the bow fully drawn, at least a portion of the power cable passes through at least a portion of a space between the first and second axle segments.

14. The pulley member of claim 13 wherein the radius of the first and second axle segments is less than about 4 mm.

15. The pulley member of claim 13 wherein and the minimum distance is greater than about 0.5 mm.

16. The pulley member of claim 13 wherein a ratio of the radius of the first and second axle segments to the minimum distance is greater than about 2:1.

17. The pulley member of claim 13 wherein a ratio of the radius of the first and second axle segments to the minimum distance is greater than about 4:1.

18. The pulley member of claim 13 wherein the pulley member is arranged so as to avoid 100% let-off of the draw force or so as to prevent cocking of the bow.

19. The pulley member of claim 13 wherein the power cable take-up mechanism comprises a power cable take-up journal non-rotatably connected to the draw cable journal.

20. The apparatus of claim 13 further comprising a second pulley member, the second pulley member comprising:

corresponding first and second substantially coaxial axle segments arranged to extend from opposite sides of the second pulley member and to rotatably connect the second pulley member to a second bow limb of a compound archery bow, which corresponding axle segments substantially define a second rotation axis relative to the second bow limb;

a corresponding draw cable journal connected to the corresponding axle segments and arranged to let out the draw cable as the bow is drawn and the second pulley member rotates about the second rotation axis;

a corresponding power cable take-up mechanism arranged to take up a second power cable as the bow is drawn and the second pulley member rotates about its rotation axis, wherein:

the second pulley member is arranged so that an effective lever arm of its power cable take-up mechanism decreases during a latter portion of drawing the bow from a distance that is greater than a radius of the corresponding axle segments to a minimum distance that is less than that radius; and the second pulley member is further arranged so that, with the bow fully drawn, at least a portion of the second power cable passes through at least a portion of a space between the corresponding first and second axle segments.

21. The apparatus of claim 20 wherein the first and second pulley members are substantially identical or substantial mirror images of one another.

22. The apparatus of claim 20 wherein the first and second pulley members are arranged so as to avoid 100% let-off of the draw force or so as to prevent cocking of the bow.

23. The pulley member of claim 13 further comprising a secondary cable let-out mechanism arranged to engage a secondary cable and to let out the secondary cable as the bow is drawn.

24. The pulley member of claim 23 wherein the pulley member is arranged so that an effective lever arm of the secondary cable let-out mechanism increases, during an initial portion of drawing the bow, from a minimum distance that is less than a radius of the axle segments to a distance that is greater than that radius.

* * * * *